US008057245B2

(12) United States Patent
Sakamaki et al.

(10) Patent No.: US 8,057,245 B2
(45) Date of Patent: Nov. 15, 2011

(54) LEVER-TYPE CONNECTOR

(75) Inventors: Kazushige Sakamaki, Tokyo (JP); Ryuichi Komiyama, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 12/892,284

(22) Filed: Sep. 28, 2010

(65) Prior Publication Data

US 2011/0014804 A1 Jan. 20, 2011

Related U.S. Application Data

(63) Continuation of application No. PCT/JP2009/055274, filed on Mar. 18, 2009.

(30) Foreign Application Priority Data

Mar. 28, 2008 (JP) ..... 2008-087616

(51) Int. Cl.
*H01R 13/62* (2006.01)

(52) U.S. Cl. ..... 439/157

(58) Field of Classification Search ..... 439/157, 439/152, 153

See application file for complete search history.

(56) References Cited

U.S. PATENT DOCUMENTS 5,509,816 A * 4/1996 Katsuma ..... 439/157
5,873,745 A * 2/1999 Duclos et al. ..... 439/157
5,938,458 A * 8/1999 Krehbiel et al. ..... 439/157
6,217,354 B1 * 4/2001 Fencl et al. ..... 439/157
6,270,376 B1 * 8/2001 Fink et al. ..... 439/595
6,305,957 B1 * 10/2001 Fink et al. ..... 439/157
6,345,995 B1 * 2/2002 Bigotto et al. ..... 439/157
6,682,359 B1 * 1/2004 Hitchcock et al. ..... 439/157
6,705,882 B2 * 3/2004 Casses ..... 439/157
6,899,554 B1 * 5/2005 Osada ..... 439/157
6,997,725 B2 * 2/2006 Stella et al. ..... 439/157

(Continued)

FOREIGN PATENT DOCUMENTS

JP 11-503558 A 3/1999

(Continued)

OTHER PUBLICATIONS

International Search Report for issued in co-pending International Application No. PCT/JP2009/05274, 1 page, dated Jun. 9, 2009.

(Continued)

*Primary Examiner* — Tulsidas Patel
*Assistant Examiner* — Vladimir Imas
(74) *Attorney, Agent, or Firm* — Barley Snyder

(57) ABSTRACT

A lever-type connector capable of preventing a worker from damaging a lever when removing the lever from a housing is provided. The lever-type connector includes a housing containing a contact, a wire cover and a lever. The wire cover includes a main body, stopper and a first tapered section formed between the main body and the stopper. The wire cover is attached to a rear side of the housing. The lever includes a pair of side plates and a connecting part that connects the pair of side plates to each other. The lever rotatably attaches to the housing by bridging over the rear side of the wire cover with the wire cover inserted between the pair of side plates in a thickness direction. The main body has a smaller thickness than a distance between the pair of side plates and the stopper has a greater thickness than the distance between the pair of side plates.

20 Claims, 14 Drawing Sheets

U.S. PATENT DOCUMENTS

| | | | | |
|---|---|---|---|---|
| 7,070,438 | B2 * | 7/2006 | Dillon | 439/347 |
| 7,361,036 | B2 * | 4/2008 | Pittenger et al. | 439/157 |
| 7,559,778 | B2 * | 7/2009 | Pittenger et al. | 439/157 |
| 7,568,925 | B2 * | 8/2009 | Ciriello et al. | 439/157 |
| 7,695,297 | B2 * | 4/2010 | Pittenger et al. | 439/157 |
| 7,837,485 | B2 * | 11/2010 | Epe et al. | 439/157 |
| 2002/0022391 | A1 * | 2/2002 | Beck et al. | 439/157 |
| 2002/0061675 | A1 * | 5/2002 | Borst | 439/404 |
| 2002/0081877 | A1 * | 6/2002 | Ohnuki | 439/157 |
| 2003/0003786 | A1 * | 1/2003 | Bakker et al. | 439/157 |
| 2004/0192090 | A1 * | 9/2004 | Flowers et al. | 439/157 |
| 2006/0234535 | A1 | 10/2006 | Ohtaka et al. | |
| 2009/0203240 | A1 * | 8/2009 | Matsumura et al. | 439/153 |
| 2011/0014805 | A1 * | 1/2011 | Sakamaki et al. | 439/153 |

FOREIGN PATENT DOCUMENTS

| | | | |
|---|---|---|---|
| JP | 2006-147492 | | 6/2006 |
| JP | 2006-324227 | A | 11/2006 |
| WO | 2007/044393 | A2 | 4/2007 |
| WO | WO 2007044393 | A2 * | 4/2007 |

OTHER PUBLICATIONS

International Preliminary Report with Written Opinion cited in co-pending PCT Application No. PCT/JP2009/055274, dated Nov. 18, 2010, 6 pages.

* cited by examiner

Prior Art

LEVER-TYPE CONNECTOR

CROSS-REFERENCE TO RELATED APPLICATIONS

This application is a continuation of PCT International Application No. PCT/JP2009/055274, filed Mar. 18, 2009, which claims priority under 35 U.S.C. §119 to Japanese Patent Application No.: JP 2008-087616, filed Mar. 28, 2008.

FIELD OF THE INVENTION

The present invention relates to a connector, and in particular to a lever-type connector to unite and release from a mating connector by rotation of a lever.

BACKGROUND

In recent years, electric connectors having numerous terminals are being used in the field of automobiles and the like, and are continually become more and more advanced. With an electric connector having numerous terminals, a large force is necessary to mate together connectors and release the connection. Therefore, in the field of automobiles and the like, a lever-type connector to mate with and release from a mating connector utilizing effect of boosting by a lever is used.

Typically, a lever of a lever-type connector is formed in a U shape and includes a pair of side plates and a connecting part for connecting the pair of side plates to each other. Moreover, a rotating pivot for attaching a lever to a housing is provided on each of inner surfaces of ends of both side plates. When attaching the lever to the housing, a worker must spread the ends of the lever manually to join both of the rotating pivots to bearings in the housing, respectively. As a result, when attaching the lever to the housing, it is possible that the worker may spread the ends of the lever too much causing a problem.

Particularly, with a lever-type connector having many electrical terminals, there are cases where reactive force developed when mating with a mating connector increases and bending of the lever occurs. If bending of the lever occurs when mating a lever-type connector with a mating connector, the mating with the mating connector is incomplete. The lever is made of a hard material in order to prevent bending of the lever from occurring when mating a lever-type connector formed multipolar with a mating connector. However, if the lever is made of a hard material, cracking of the lever easily occurs when the worker is spreading the end of the lever.

As a result, a lever-type connector capable of preventing the worker from damaging the lever when attaching the lever to the housing has been developed.

As a conventional lever-type connector capable of reducing damages to the lever by the worker when attaching the lever to the housing, for example, the connector shown in FIG. 21 is well-known.

A lever-type connector 100 shown in FIG. 21 includes a connector housing 110, and a lever 120 attached rotatable in the connector housing 110.

The connector housing 110 includes a terminal receiving portion 111 for receiving a terminal, and an outer tube 112 encompassing the terminal receiving portion 111. A lever installing part 113 for installing the lever 120 is provided on either side of the outer tube 112. Both of the lever installing parts 113 are formed in a pouch form opening toward the front. A lead-in groove 114 is formed on either side of both of the lever installing parts 113. A pivot receiving portion 15 for holding a rotating pivot 123 of the lever 120 is provided on each back end of the respective lead-in grooves 114.

The lever 120 is overall formed in a U shape and includes a pair of side plates 121 (only one is shown in the drawing) and a connecting part 122 for connecting ends of the side plates 121 to each other. The rotating pivot 123 is provided extending inward on respective inner surfaces of the ends of the side plates 121. In addition, a gear piece 124 for joining to a rack 210 of a mating connector 200 is provided at the outer circumference of the respective rotating pivots 123.

When attaching the lever 120 to the connector housing 110, the end of the lever 120 is spread apart, first, and then both of the rotating pivots 123 of the lever 120 are inserted into the lead-in grooves 114 of the lever installing part 113, respectively. Next, the end of the lever 120 is moved while aligning the inner surface of both of the side plates 121 with the outer surface of the lever installing parts 113, and the rotating pivots 123 of both of the side plates 121 are joined to the pivot receiving portions 115 of the lever installing parts 113, respectively.

In this manner, with the lever-type connector 100, the worker does not need to perform the operation of spreading the end of the lever 120 and operation of moving the lever 120 to a predetermined position simultaneously. As a result, the worker may be dedicated to the operation of moving the lever to a predetermined position.

Accordingly, with the lever-type connector 100, provision of the lever installing parts 113 formed in a pouch shape allows easy application of the U-shaped lever 120 to the connector housing 110.

However, with the lever-type connector 100 shown in FIG. 21, a mechanism that aggressively spreads the end of the lever 120 is not provided. Accordingly, with the lever-type connector 100, damage of the lever 120 cannot be prevented when the worker spreads the end of the lever 120.

Moreover, there are cases where a contact may be replaced during maintenance of a lever-type connector onboard an automobile or the like.

In particular, with a lever-type connector having a wire cover, which covers electrical wires connected to contacts contained in a housing, the worker must remove the levers and the wire cover from the housing manually when replacing a contact.

As a result, with a lever-type connector with a wire cover, when removing the lever from the housing, there is a problem that the worker damages the lever by spreading the end of the lever too much.

SUMMARY

The invention has been made in view of the above problems in the conventional design, and it is an objective of the invention to provide a lever-type connector capable of preventing a worker from damaging a lever when removing the lever from a housing. Moreover, another objective of the invention among others is to provide a lever-type connector capable of preventing a worker from damaging the lever when attaching the lever to a housing.

A lever-type connector capable of preventing a worker from damaging a lever when removing the lever from a housing is provided. The lever-type connector includes a housing containing a contact, a wire cover and a lever. The wire cover includes a main body, stopper and a first tapered section formed between the main body and the stopper. The wire cover is attached to a rear side of the housing. The lever includes a pair of side plates and a connecting part that connects the pair of side plates to each other. The lever rotatably attaches to the housing by bridging over the rear side of the wire cover with the wire cover inserted between the pair of side plates in a thickness direction. The main body has a smaller thickness than a distance between the pair of side plates and the stopper has a greater thickness than the distance between the pair of side plates.

BRIEF DESCRIPTION OF THE DRAWINGS

The invention is described in more detail in the following with reference to the embodiments shown in the drawings. Similar or corresponding details in the FIGS. are provided with the same reference numerals. The invention will be described in detail with reference to the following figures of which.

DETAILED DESCRIPTION OF THE EMBODIMENT(S)

Figure 1:
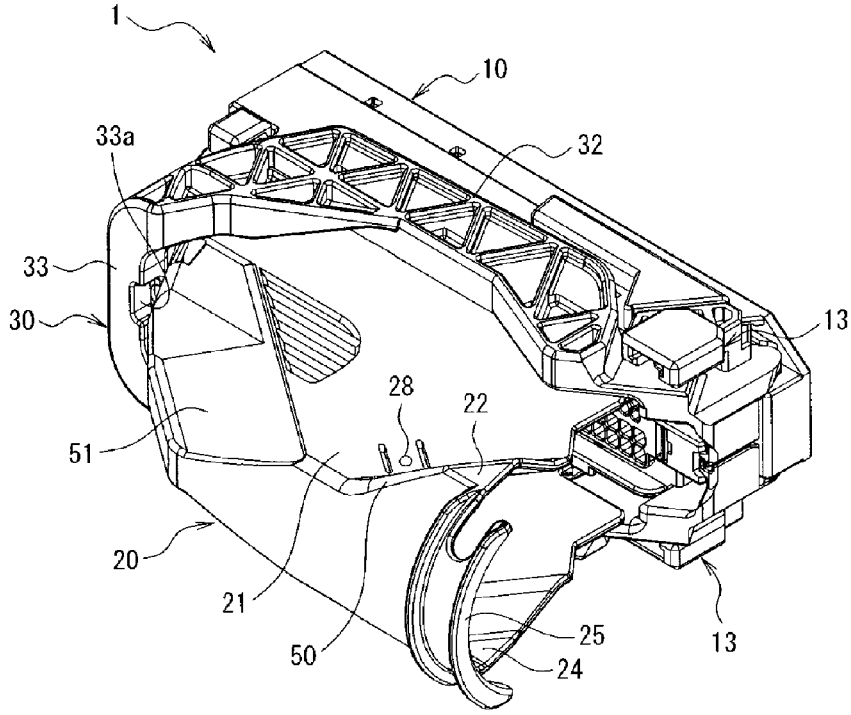
FIG. 1 is a perspective view of a top surface side of a lever-type connector according to the present invention.

Hereinafter, a lever-type connector according to the invention will be described with reference to the drawings.

The lever-type connector 1 shown in FIGS. 1 to 7 includes a housing 10, which contains multiple contacts (not illustrated in the drawings), a wire cover 20, which is attached to a rear side (upper side in FIG. 3) of the housing 10, and a lever 30, which is attached to the housing 10.

Figure 2:
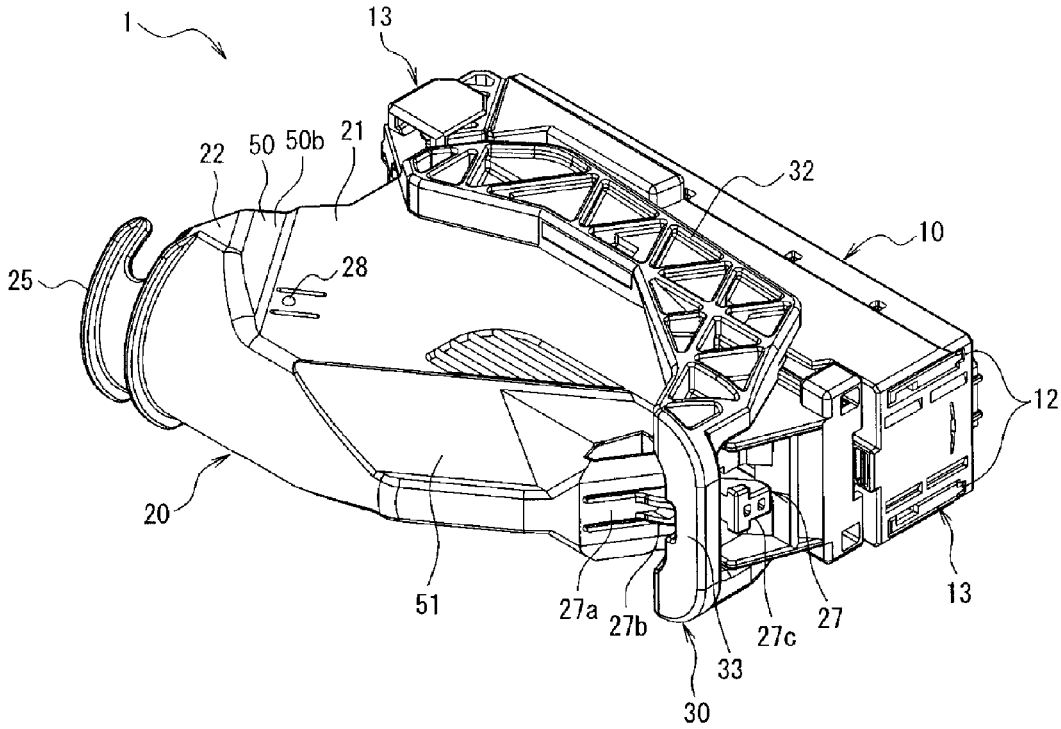
FIG. 2 is a perspective view of a bottom surface side of the lever-type connector of FIG. 1.
Figure 3:
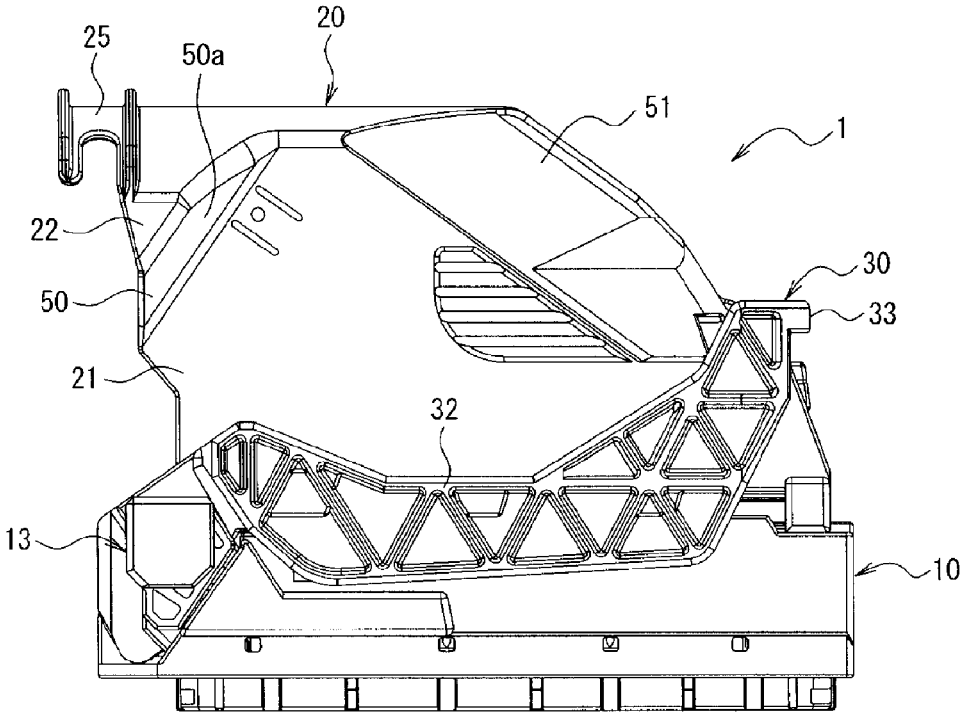
FIG. 3 is a plan view of the lever-type connector of FIG. 1.
Figure 4:
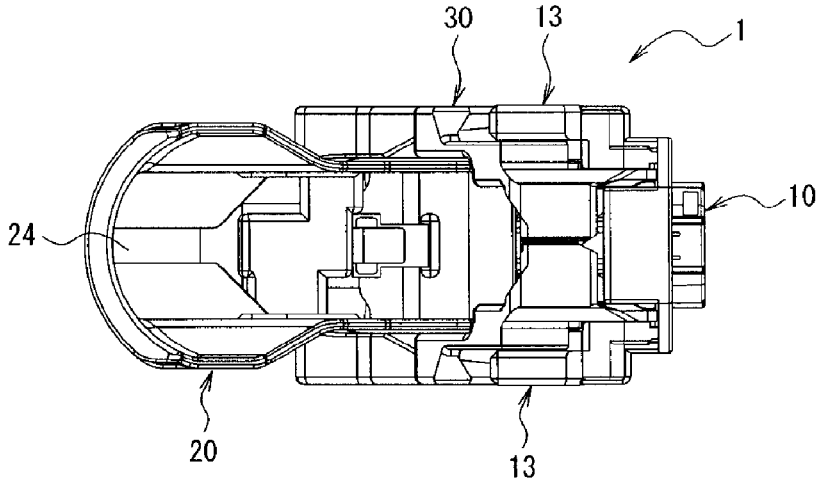
FIG. 4 is a side view of one side of the lever-type connector of FIG. 1.
Figure 5:
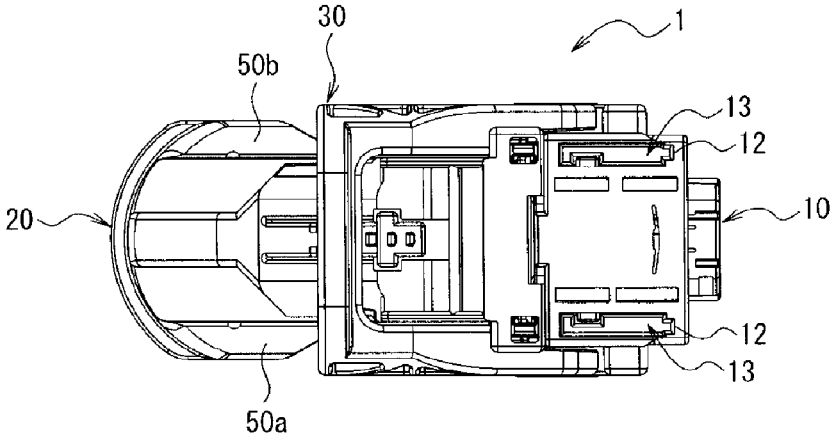
FIG. 5 is a side view of the other side of the lever-type connector of FIG. 1.
Figure 6:
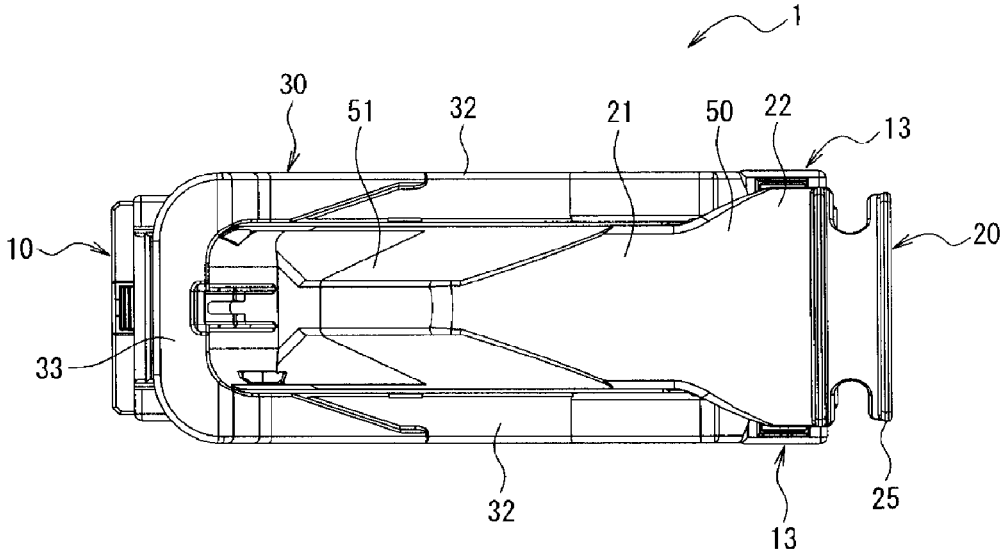
FIG. 6 is a rear view of the lever-type connector of FIG. 1.
Figure 7:
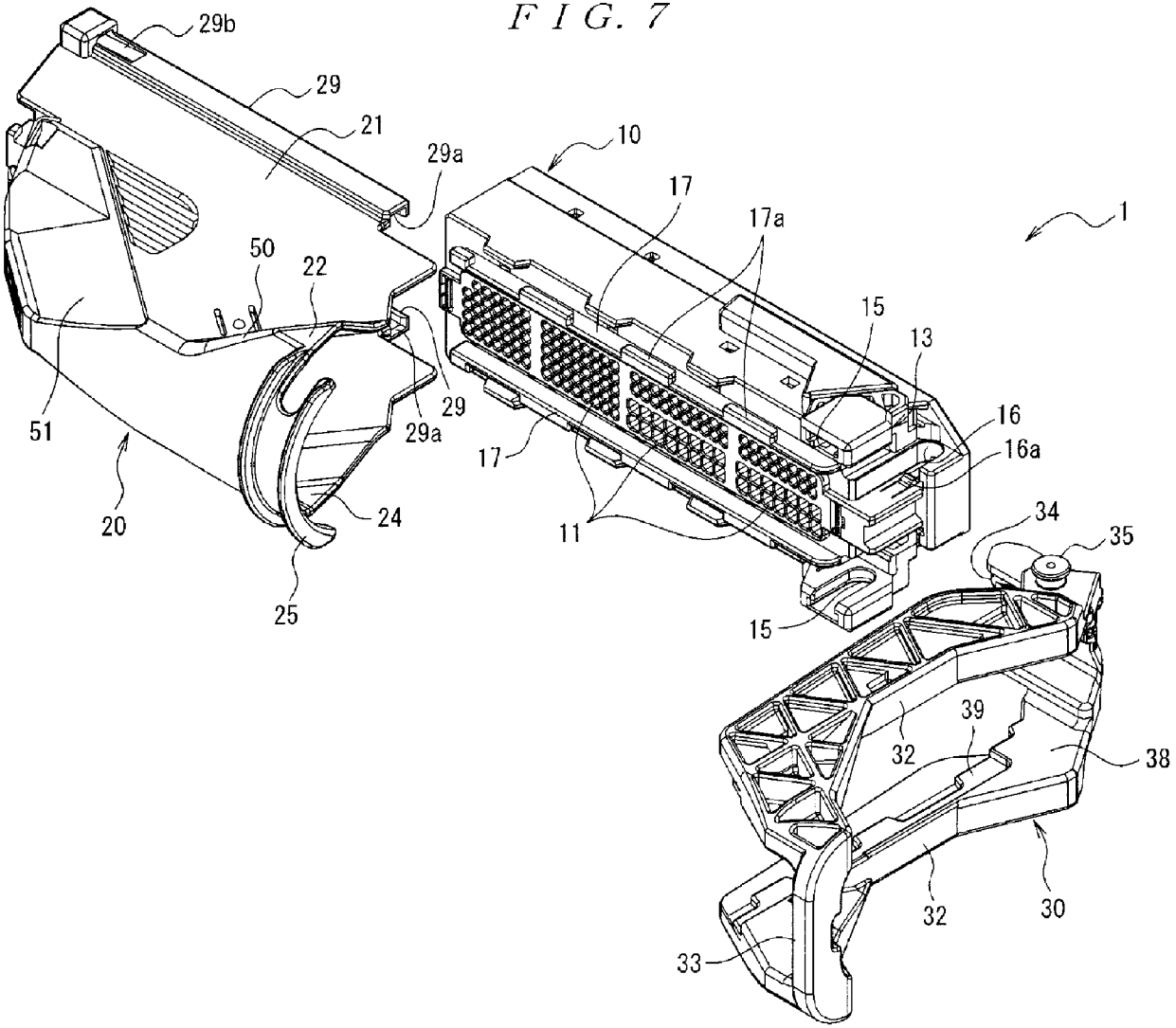
FIG. 7 is a perspective view of the lever-type connector of FIG. 1 in a disassembled state.

The housing 10 has multiple contact receiving holes 11, as shown in FIG. 7. As shown in FIG. 2 and FIG. 5, a slider receiving slot 12 is provided and extends on either inner surface of the housing 10 (see FIG. 4 and FIG. 5). A slider 13 is received in each of the sliding receiving slots 12 so as to move freely. As shown in FIG. 7, a pair of pivot receiving portions 16 is provided on an end of the housing 10, and join with pivots 34 of the lever 30, respectively. A latch arm 16*a* for locking the pivot 34 of the lever joined to each of the pivot receiving portions 16 is provided at the rear of each of the bearings of the housing 10. Securing pieces 17 for fixing the wire cover 20 are provided on either end of the rear surface of the housing, as shown in FIG. 7. Both of the fixing pieces 17 are provided protruding toward the rear. Multiple (four in this embodiment) fixing projections 17*a*, which protrude toward the outside, are provided on the outer side surface of each of the fixing pieces 17.

Each of the sliders 13 is formed in a plate shape. Multiple cam grooves (not illustrated in the drawings), which lead in and push out cam pins (not illustrated in the drawings) provided on a mating connector, are provided on the inner surface of each of the sliders 13. Moreover, as shown in FIG. 7, projection receiving portions 15 are each provided on an end of each of the sliders 13. Each projection receiving portion 15 joins to a slider moving projection 35 of the lever 30.

The lever 30 is formed in a U shape and includes a connecting part 33 for connecting a pair of side plates 32 extending and connecting the other ends of both of the side plates 32 to each other.

Figure 8:
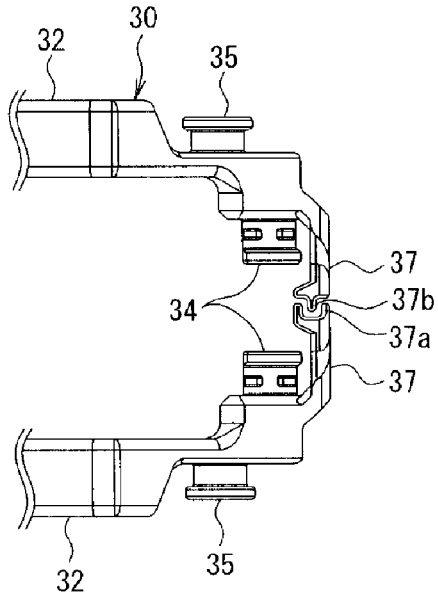
FIG. 8 is an enlarged rear view of an end of a lever according to the lever-type connector of FIG. 1.

Each slider moving projection 35, which joins to the projection receiving portion 15 of each of the sliders 13, respectively, is formed protruding outward from an outer surface of an end of both of the side plates 32, as shown in FIG. 7 and FIG. 8. The pivot 34, which joins to each of the pivot receiving portions 16 of the housing 10, is provided and protrudes inward from the inner surface of the end of both of the side plates 32. Moreover, connecting plates 37, each extending inward, are provided on the inner surface of the end of both of the side plates 32, as shown in FIG. 8. Respective ends of both of the side plates 32 are joined to each other by a depression 37*a*, provided at the end of the connecting plate 37 of one of the side plates 32, and a projection 37*b*, which is provided on end of connecting plate 37 of the other side plate 32. Furthermore, a flat part 38 is formed on the inner surface on an end side of each of the side plates 32. The flat part 38 makes contact with a slant face 50*a* of the wire cover 20, when removing the lever 30 from the housing 10. In addition, notches 39 are provided on the inner surface of both of the side plates 32.

As shown in FIG. 1, a depression 33*a* is provided to the connecting part 33, and latches to a locking piece 27*b* of a lock 27 of the wire cover 20.

More specifically, the wire cover 20 includes a main body 21, which covers electrical wires (not illustrated in the drawings) connected to the contacts contained in the housing 10, a stopper 22, which is provided on a side of the main body 21, and a first tapered portion 50, which is formed between the main body 21 and the stopper 22. Thickness of the main body 21 is less than the distance between both of the side plates 32 of the lever 30. Meanwhile, thickness of the stopper 22 is greater than the distance between both of the side plates 32 of the lever 30. As a result, the stopper 22 deters the lever 30 that has been rotated until the final position (see FIG. 18) at the rear from rotating further toward the rear.

An electrical wire outlet 24, which leads out the electrical wires connected to the contacts that are contained in the housing 10, is provided on an end of the stopper 22. Moreover, a hood portion 25, protruding toward one side, is provided circumferentially to the electrical wire outlet 24 of the stopper 22. The outer surface of the hood portion 25 is formed in an arc shape.

The first tapered portion 50 is formed so as to connect to the main body 21 and the stopper 22. The first tapered portion 50 includes a slanted face 50*a*, which continues to the top surface of the main body 21 and the top surface of the stopper 22, and a slated face 50*b*, which continues to the bottom surface of the main body 21 and the bottom surface of the stopper 22.

As shown in FIG. 2, the lock 27 is provided on the rear surface of the main body 21. The lock 27 prevents the lever 30, which has been rotated until the final position (see FIG. 19 and FIG. 20) on the front side, from rotating toward the rear side. The lock 27 is formed in a cantilever plate-spring form and extends from the rear side toward the front side of the connecting part 33 of the lever 30 when positioned at the final position on the front side. The lock 27 has a plate spring 27*a*, and a locking piece 27*b* and a release projection portion 27*c* provided on the outer surface of the plate spring 27*a*. The plate spring 27*a* is provided and extends from the rear toward the front of the connecting part 33 of the lever 30 positioned at the final position on the front side. The locking piece 27*b* is provided for latching onto the depression 33*a* of the connecting part 33 when positioned at the final position on the front side. The release projection portion 27*c* is provided so as to be positioned on the front side of the connecting part 33 of the lever 30 when positioned at the final position on the front side.

Lock projection portions 28, which prevent the lever 30 that has been rotated until the final position on the front side from rotating toward the rear, are provided on the top surface and the bottom surface of the main body 21. Each of the lock projection portions 28 is provided for latching onto the sides of the notches 39 of each of the side plates 32 of the lever 30 positioned at the final position on the rear side.

Fixed parts 29 for fixing the wire cover 20 to the housing 10 are provided on the front end of the top surface and the front end of the bottom surface of the main body 21, as shown in FIG. 7. Both of the receiving parts 29 are provided so as to protrude outward. A fixing groove 29*a* into which the fixing projections 17*a* of the housing 10 are inserted is provided to the respective inner surfaces of the receiving parts 29. A latch arm 29*b* is provided on the other end of each of the receiving parts 29. Projections (not illustrated in the drawings) for latching onto the side of the fixing projections 17*a* of the housing 10 are provided on each of the latch arms 29.

A second tapered portion 51, which has a thickness that gradually decreases toward the outer side, is formed on the rear surface of the main body 21.

An assembling method of the lever-type connector 1 will now be described.

When assembling the lever-type connector 1, contacts respectively connect to electrical wires (not illustrated in the drawings) are received in the multiple contact receiving holes 11 of the housing 10 of the lever-type connector 1 in the disassembled state, shown in FIG. 7. Moreover, the respective sliders 13 are inserted into both of the slider receiving slots 12 of the housing 10.

Figure 9:
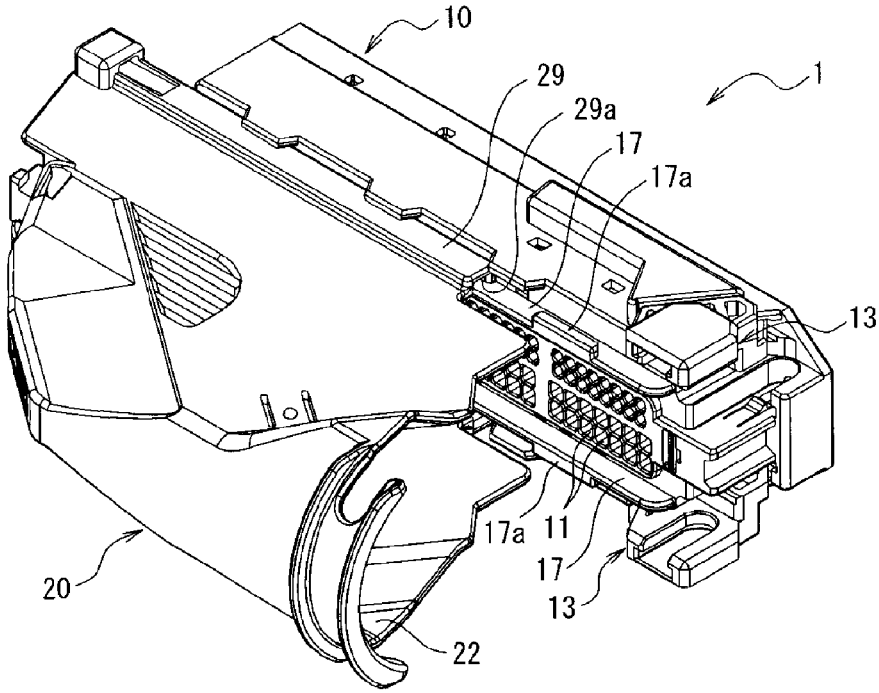
FIG. 9 is a perspective view of the top surface side and one side where a wire cover is being attached to a housing according to the present invention.
Figure 10:
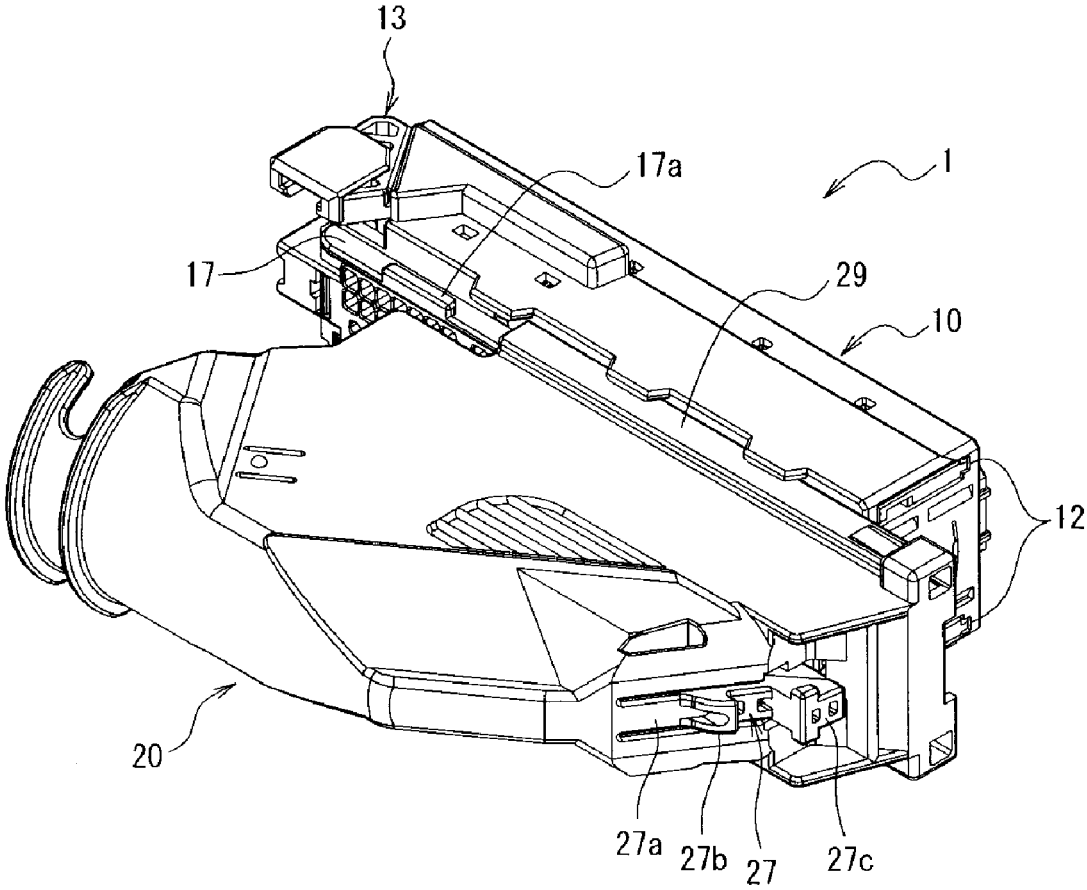
FIG. 10 is a perspective view of the bottom surface side and the other side where a wire cover is being attached to a housing according to the present invention.

Next, the wire cover 20 is attached to the housing 10 which contains the multiple contacts. When attaching the wire cover 20 to the housing 10, the wire cover 20, arranged on the rear side of the housing 10, is slid from one side to the other side of the housing 10, as shown in FIG. 9 and FIG. 10. As a result, the multiple fixing projections 17*a* of both of the fixing pieces 17 of the housing 10 are inserted into the fixing grooves 29*a* of each of the receiving parts 29 of the wire cover 20. At this time, the multiple fixing projections 17*a* are inserted into the fixing grooves 29*a* from one side of the fixing grooves 29*a* in order from those on the other side. Once the wire cover 20 slides and the sides of the fixing projections 17*a* bump into wall surfaces on the other side of the fixing grooves 29*a*, attachment of the wire cover 20 to the housing 10 is complete, as shown in FIG. 11.

When attachment of the wire cover 20 to the housing 10 is completed, the projections, which are provided on the latch arms 29*b* of the receiving parts 29, latching onto the sides on the other side of the fixing projections 17*a* provided furthest on the other side locks the wire cover 20. Moreover, when attachment of the wire cover 20 to the housing 10 is complete, the bound, electrical wires connected to the multiple contacts contained in the housing 10 are lead out from the electrical wire outlet 24 of the wire cover 20.

The lever 30 is then attached to the housing 10 to which the wire cover 20 is attached. When attaching the lever 30 to the housing 10 to which the wire cover 20 is attached, the lever 30 is arranged in the wire cover 20 so as for both of the side plates 32 to bridge over the rear side of the wire cover 20 and sandwich the wire cover 20 between both of the side plates 32.

Figure 11:
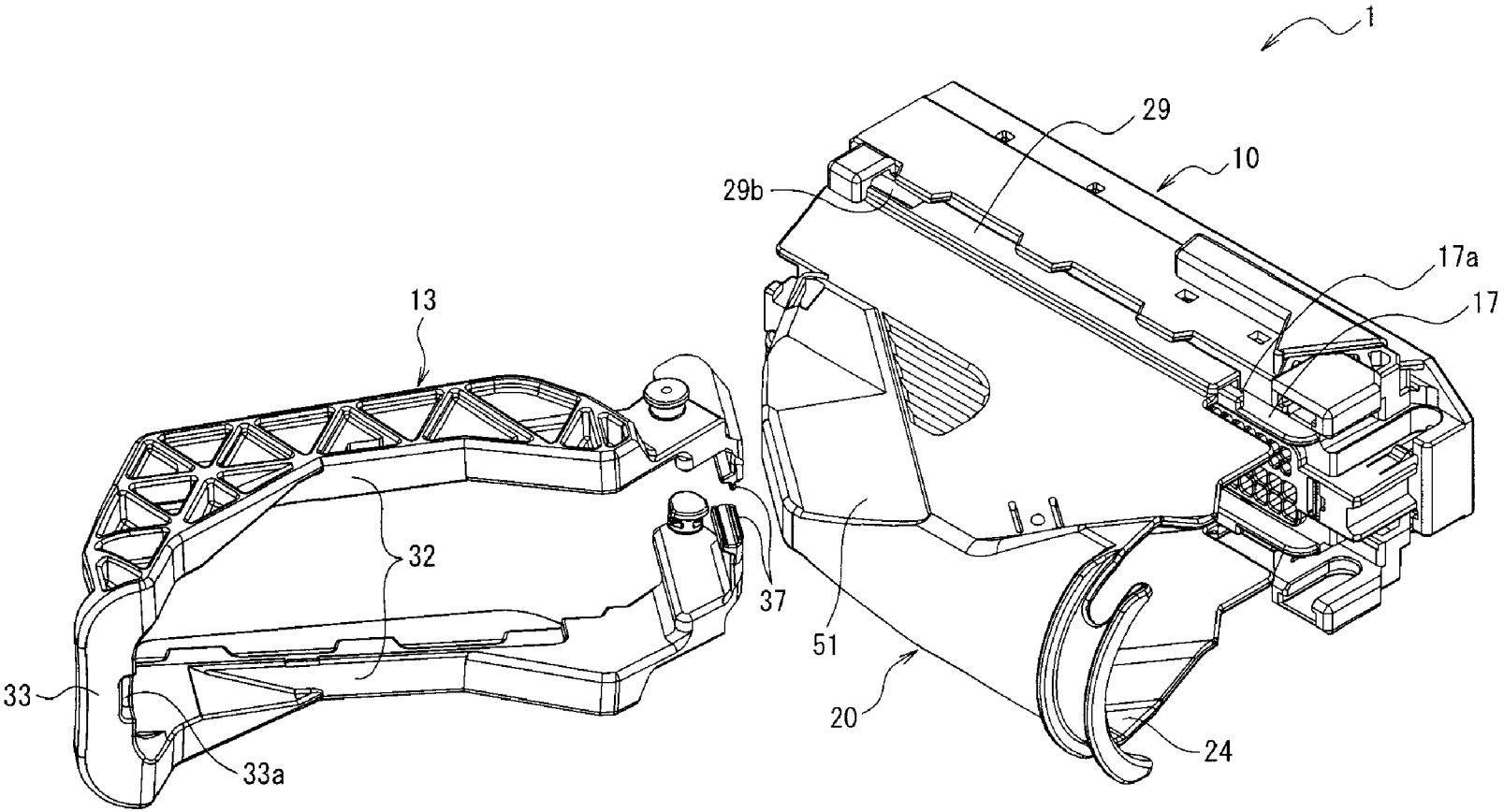
FIG. 11 is a perspective view where attachment of the wire cover to the housing is completed, and a lever is not attached.

Accordingly, when attaching the lever 30 to the housing 10, as shown in FIG. 11, the ends of both of the side plates 32 of the lever 30 are first spread manually, and the distance between the ends of the connecting plates 37 of both of the side plates 32 is one allowing insertion of the edge of the second tapered portion 51 of the wire cover 20. When ends of both of the side plates 32 of the lever 30 are spread manually, the edge of the second tapered portion 51 of the wire cover 20 is inserted into between the ends of both of the connecting plates 37.

Once the edge of the second tapered portion 51 of the wire cover 20 is inserted in between the ends of the connecting plates 37 of both of the side plates 32 of the lever 30, spreading of both of the side plates 32 is stopped manually, and both of the connection plates 37 are then brought into contact with the surface of the second tapered portion 51. The lever 30 is pushed in, such that the ends of the connecting plates 37 of both of the side plates 32 move toward the front side of the wire cover 20.

Once the lever 30 is pushed in, the ends of the connecting plates 37 of both of the side plates 32 move along the surface of the second tapered portion 51. The second tapered portion 51 of the wire cover 20 then pushes apart the ends of both of the side plates 32 of the lever 30.

Figure 12:
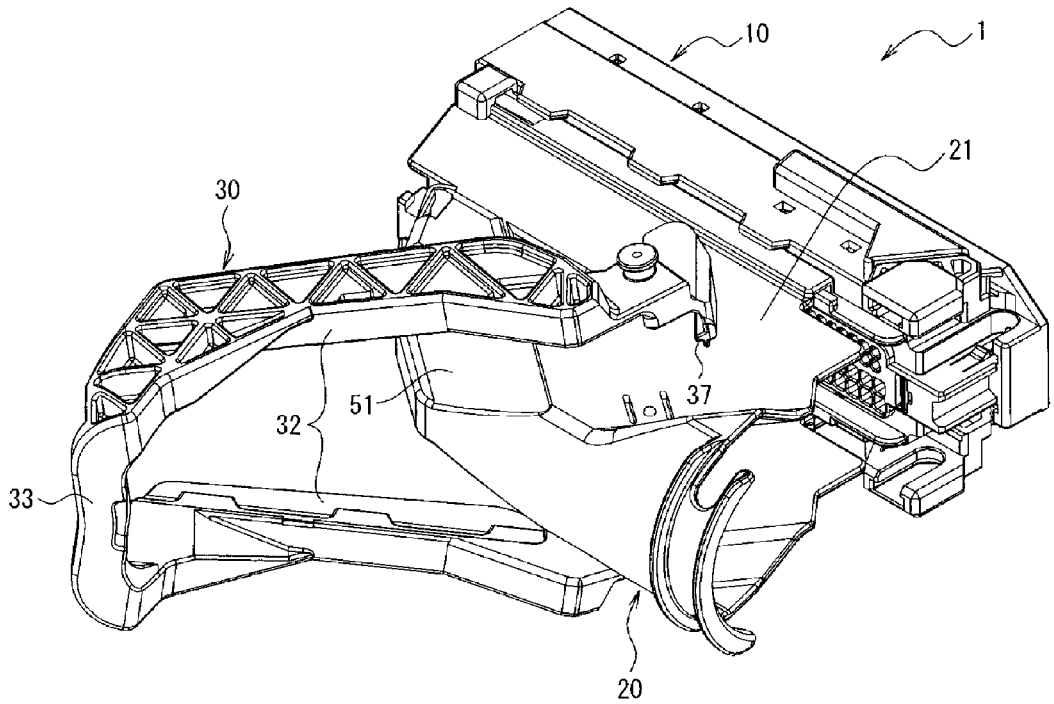
FIG. 12 is a perspective view where the wire cover is being positioned between both side plates of the lever.

Once the lever 30 is pushed further inward, the ends of the connecting plates 37 of both of the side plates 32 move from the surface of the second tapered portion 51 of the wire cover 20 to the surface of the main body 21. Afterward, the ends of the connecting plates 37 of both of the side plates 32 on the lever 30 are moved along the surface of the main body 21 of the wire cover 20, as shown in FIG. 12.

Figure 13:
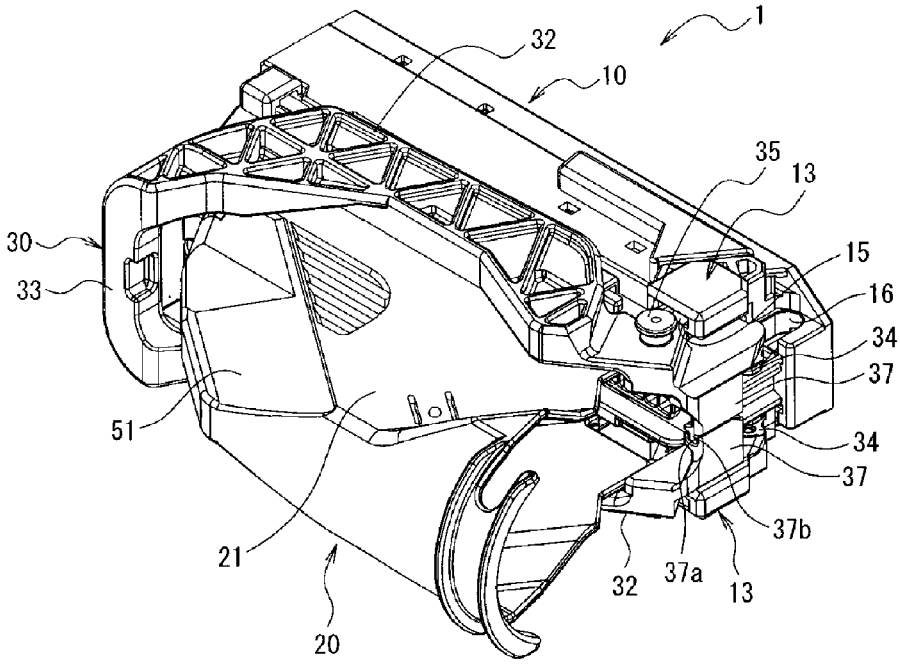
FIG. 13 is a perspective view where the wire cover is positioned between both side plates of the lever.

Once the lever 30 is pushed further inward, the ends of the connecting plates 37 of both of the side plates 32 go over the main body 21 of the wire cover 20, as shown in FIG. 13. Deformation of the connecting parts 33 of the lever 30 returns to the normal formation again, and the depression 37*a* provided on the end of the connecting plate 37 of one of the side plates 32 and the projection 37*b* provided on end of connecting plate 37 of the other side plate 32 are connected. As a result, the lever 30 is arranged in the wire cover 20 when both of the side plates 32 bridge over the rear side of the wire cover 20, and both of the side plates 32 sandwich the wire cover 20.

Figure 14:
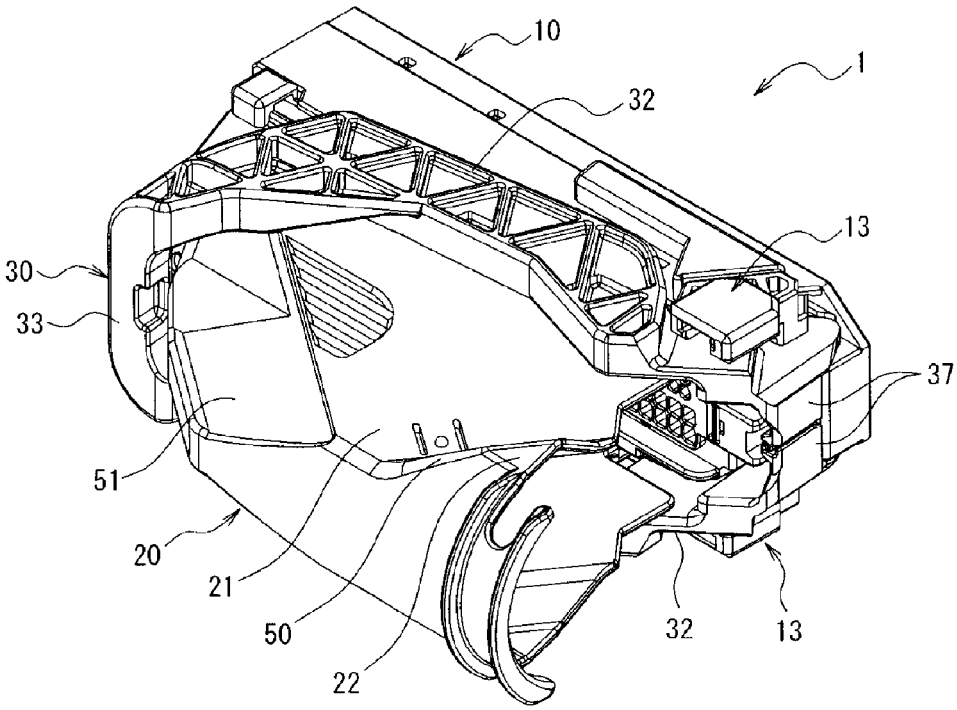
FIG. 14 is a perspective view where assembly of the lever-type connector is completed.

Then, the pivots 34 of both of the side plate 32 on the lever 30 are mated to respective pivot receiving portion 16 of the housing 10, and the slider moving projection 35 of the respective side plates 32 of the lever 30 is connected to respective projection receiving portions 15 of the sliders 13. This attaches the lever 30 to the wire cover 20, as shown in FIG. 14, thereby completing assembly of the lever-type connector 1.

With the lever-type connector 1, the second tapered portion 51, which has a thickness that gradually decreases toward the outer rear side of the main body 21 of the wire cover 20, is formed in this manner. Accordingly, when a worker attaches the lever 30 to the housing 10, the ends of both of the side plates 32 should be spread such that the distance between the ends of the connecting plates 37 of both of the side plates 32 is one allowing insertion of the edge of the second tapered portion 51 of the wire cover 20. By pushing the lever 30 inward thereafter, the second tapered portion 51 of the wire cover 20 pushes apart the ends of both of the side plates 32 of the lever 30 such that the distance between the ends of the connecting plates 37 of both of the side plates 32 is equivalent to thickness of the main body 21 of the wire cover 20.

Here, the thickness of the end of the second tapered portion 51 of the wire cover 20 is formed sufficiently less than that of the main body 21.

Accordingly, when a worker attaches the lever 30, both of the side plates 32 do not need to be spread until the distance between the ends of the connecting plates 37 of both of the side plates 32 is greater than thickness of the main body 21 of the wire cover 20. Moreover, the lever 30 is formed such that the distance between the connecting plates 37 of both of the side plates 32 is equivalent to thickness of the wire cover 20 of the main body 21 so as to be strong enough that it does not break the connecting part 33 even if it deforms it.

As a result, according to the lever-type connector 1, when attaching the lever 30 to the housing 10, excess spreading of the end of the lever 30 by the worker may be prevented, and thereby preventing damage to the lever 30.

The method of replacing a contact of the lever-type connector 1 will be described next.

With the lever-type connector 1, it is necessary to remove the wire cover 20 from the housing 10 so as to expose the contact contained in the housing 10 in order to replace the contact. Moreover, with the lever-type connector 1, in order to remove the wire cover 20 from the housing 10, it is necessary to remove the lever 30, which is arranged bridging the rear side of the wire cover 20, from the wire cover 20.

When replacing a contact of the lever-type connector 1, the lever 30 is first removed from the wire cover 20 of the lever-type connector 1 in the assembled state shown in FIG. 14.

When removing the lever 30 from the wire cover 20, the pivots 34 of both of the side plates 32 of the lever 30 are first removed from each of the bearings 16 of the housing 10, as shown in FIG. 13. The slider moving projections 35 of both of the side plates 32 of the lever 30 are then removed from the projection receiving portions 15 of each of the sliders 13.

Next, the lever 30 is pushed in to move the ends of both of the side plates 32 toward the rear side of the wire cover 20.

Figure 15:
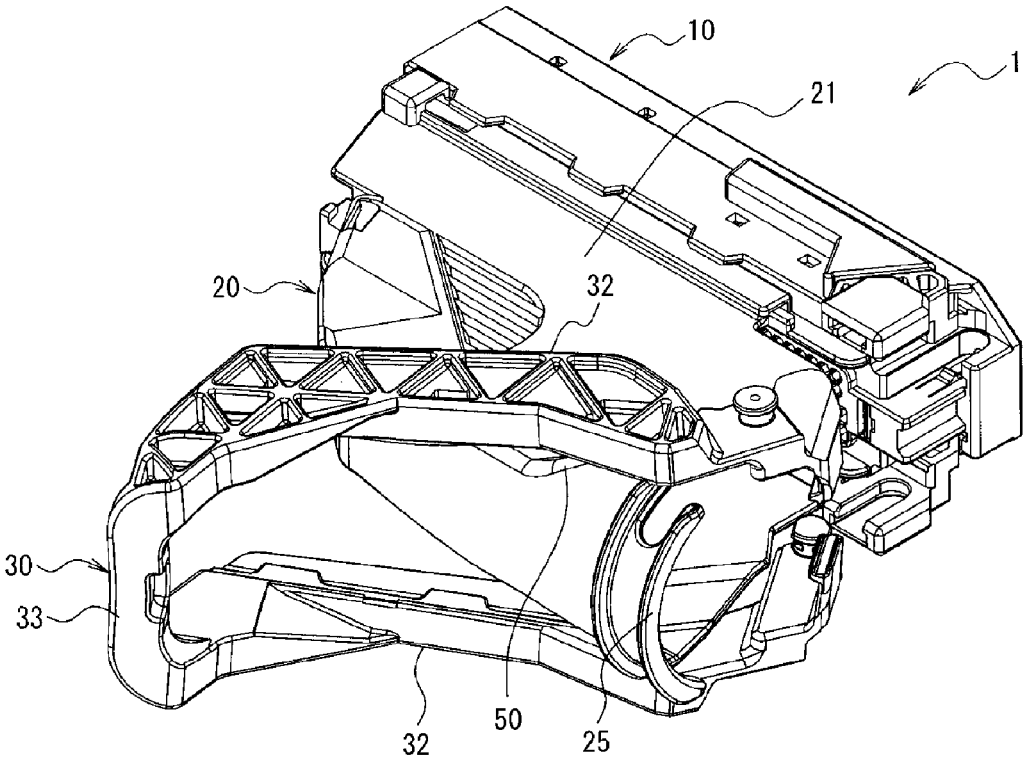
FIG. 15 is a perspective view where the lever according to the invention is being removed from the wire cover.

Once the lever 30 is pushed in, the flat portions 38 of both of the side plates 32 make contact with the second tapered portion 50 of the wire cover 20. Once the lever 30 is pushed further inward, the flat portions 38 of both of the side plates 32 move along the slanted faces 50*a* and 50*b* of the first tapered portion 50 of the wire cover 20, as shown in FIG. 15. The first tapered portion 50 of the wire cover 20 then pushes apart the ends of both of the side plates 32 of the lever 30.

Figure 16:
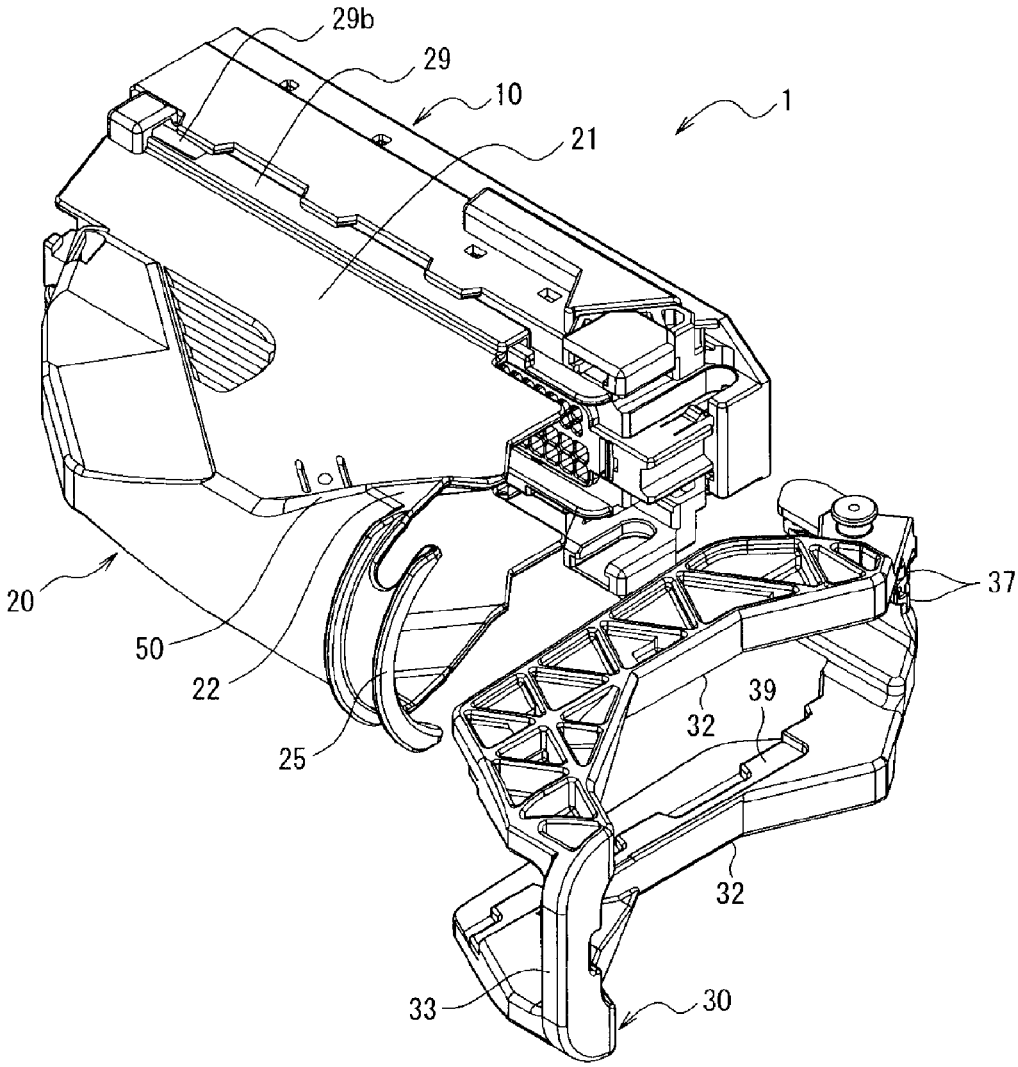
FIG. 16 is a perspective view where removal of the lever from the wire cover is completed.

Once the lever 30 is slid even further inward, the ends of both of the side plates 32 bridge over the stopper 22 of the wire cover 20, as shown in FIG. 16. Deformation of the connecting parts 33 of the lever 30 returns to the normal formation again, and the depression 37*a* provided at the end of the connecting plate 37 of one of the side plates 32 and projection 37*b* provided on end of connecting plate 37 of the other side plate 32 are joined. This removes the lever 30 from the wire cover 20. In this case, although not illustrated in the drawings, the lever 30 is when both of the side plates 32 bridge over the electrical wires that are lead out from the electrical wire outlet 24 of the wire cover 20.

With the lever-type connector 1, the first tapered portion 50 continuing to the main body 21 is formed on the stopper 22 in this manner. Therefore, the worker does not need to spread the ends of both of the side plates 32 when removing the lever 30 from the housing 10. Namely, the worker pushes the lever 30 in toward the rear of the wire cover 20, making the first tapered portion 50 of the wire cover 20 push apart the ends of both of the side plates 32 such that the distance between both of the side plates 32 is equivalent to thickness of the stopper 22 of the wire cover 20.

As a result, according to the lever-type connector 1, when removing the lever 30, excess spreading of the end of the lever 30 by the worker may be prevented, and thereby preventing damage to the lever 30.

Next, the contact contained in the housing 10 is exposed by removing the wire cover 20 from the housing 10. When removing the wire cover 20 from the housing 10, the lock by the latch arm 29*b* of the wire cover 20 is released, and the wire cover 20 is slid from one side toward the other side of the housing 10. This makes the wire cover 20 removed from the housing 10, allowing replacement of the contact accommodated in the housing 10, as shown in FIG. 7.

After replacement of the contact in the housing 10 is completed, the wire cover 20 is reattached to the housing 10 in the aforementioned sequence.

The lever 30 is then reattached to the housing 10 to which the wire cover 20 is mounted. When reattaching the lever 30 to the housing 10 to which the wire cover 20 is attached, the notches 39 of both of the side plates 32 of the lever 30 are brought into contact with the outer surface of the hood portion 25 of the stopper 22 on the wire cover 20. The lever 30 is pushed inward so as to move the notches 39 of both of the side plates 32 of the lever 30 toward the front of the wire cover.

Figure 17:
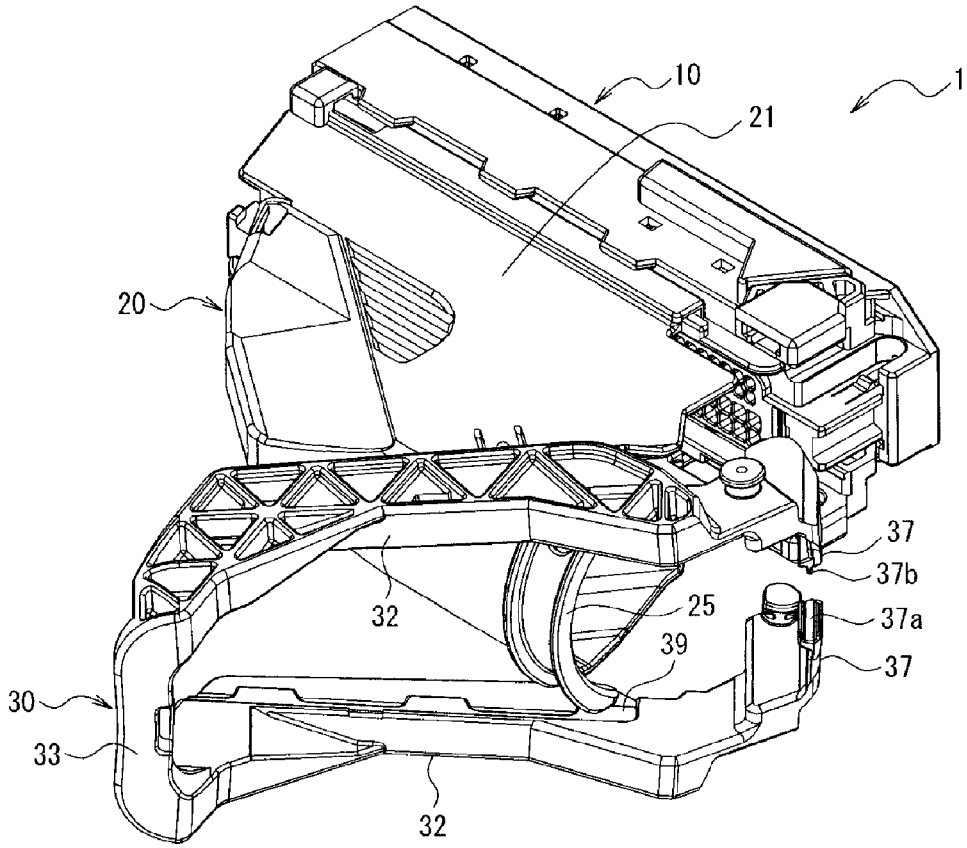
FIG. 17 is a perspective view where the lever is being reattached to the wire cover.

Once the lever 30 is pushed in, the notches 39 of both of the side plates 32 are moved along the arc-shaped outer surface of the hood portion 25 of the stopper 22 of the wire cover 20, as shown in FIG. 17. The hood portion 25 of the stopper 22 on the wire cover 20 then pushes apart the ends of both of the side plates 32 of the lever 30.

Once the lever 30 is pushed even further inward, the ends of both of the side plates 32 go over the stopper 22 of the wire cover 20, as shown in FIG. 13. Any deformation of the connecting parts 33 of the lever 30 returns to normal again, and the depression 37*a* provided at the end of the connecting plate 37 of one of the side plates 32 and projection 37*b* provided on end of connecting plate 37 of the other side plate 32 are joined. As a result, the lever 30 is arranged in the wire cover 20 when both of the side plates 32 bridge over the rear side of the wire cover 20, and both of the side plates 32 sandwich the wire cover 20.

Then, the pivots 34 of both of the side plate 32 on the lever 30 are joined to respective pivot receiving portions 16 of the housing 10, and the slider moving projections 35 of both of the side plates 32 of the lever 30 are joined to respective projection receiving portions 15 of the sliders 13. This attaches the lever 30 to the wire cover 20, as shown in FIG. 14, thereby completing assembly of the lever-type connector 1.

With the lever-type connector 1, the hood portion 50 is provided on the stopper 22 in this manner. Therefore, the worker does not need to spread the ends of both of the side plates 32 when reattaching the lever 30 to the housing 10. Namely, the worker pushes the lever 30 in toward the front of the wire cover 20, making the hood 25 of the stopper 22 of the wire cover 20 push apart the ends of both of the side plates 32 such that the distance between both of the side plates 32 is equivalent to thickness of the stopper 22 of the wire cover 20.

As a result, according to the lever-type connector 1, when reattaching the lever 30 to the housing 10, excess spreading of the end of the lever 30 by the worker may be prevented, and thereby preventing damage to the lever 30.

A method of use of the lever-type connector 1 will now be described.

With the lever-type connector 1 in the assembled state shown in FIG. 14, if the lever 30 is rotated toward the front, the sliders 13 are moved in the direction of going into the slider receiving slot 12 of the housing 10. Moreover, if the lever 30 is rotated toward the rear, the sliders 13 are moved in the direction of coming out from the slider receiving slot 12 of the housing 10.

Figure 18:
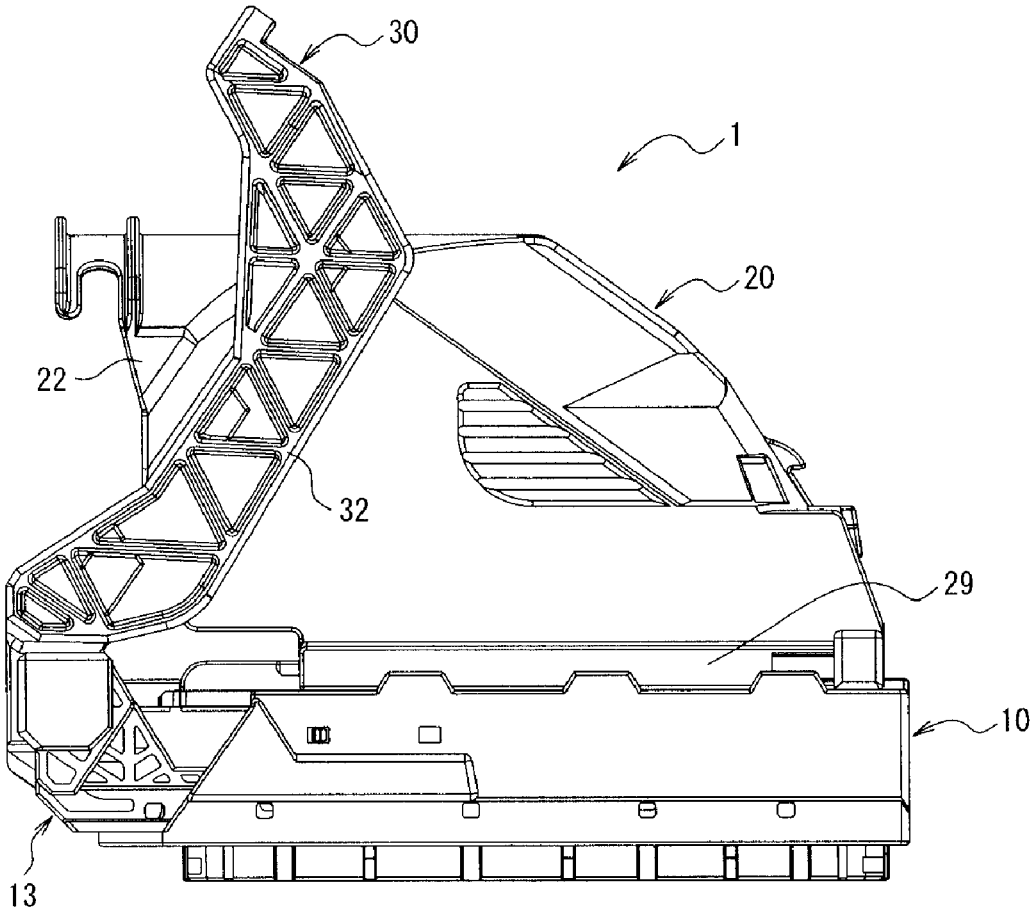
FIG. 18 is a plan view a lever-type connector according to the invention where a lever is turned to a final position on the rear side.

When mating the lever-type connector 1 to a mating connector, the lever 30 is first brought into a state of being rotated until the final position on the rear side, as shown in FIG. 18. The lever 30 that is rotated until the final position on the rear side is in a state unable to be rotated any further toward the rear by the stopper 22. Moreover, the lever 30 that has been rotated until the final position on the rear side is when rotation toward the front is intercepted by the lock projection portion 28 of the main body 21 of the wire cover 20 latching onto the sides of the notches 39 of both of the side plates of the lever 30. Furthermore, when the lever 30 has been rotated until the final position on the rear side, the sliders 13 are moved in the direction of coming out from the slider receiving slot 12 of the housing 10 so as to allow insertion of cam pins provided on the mating connector into cam grooves of the sliders 13.

Then, when the lever 30 has been rotated until the final position on the rear side, the cam pins provided on the mating connector are inserted into the multiple cam grooves of the sliders 13, temporarily mating the lever-type connector 1 and the mating connector.

Next, the lock of the lever 30 by the lock projection portion 28 of the main body 21 of the wire cover 20 is released, and the lever 30 that has been rotated until the final position on the rear side is rotated toward the front. Once the lever 30 is rotated toward the front, the sliders 13 are moved in the direction of going into the slider receiving slot 12 of the housing 10 so that the cam grooves of the sliders 13 lead the cam pins that are provided to the mating connector toward the rear. As a result, the multiple contacts contained in the housing 10 of the lever-type connector 1 are mated with contacts accommodated in the mating connector.

Figure 19:
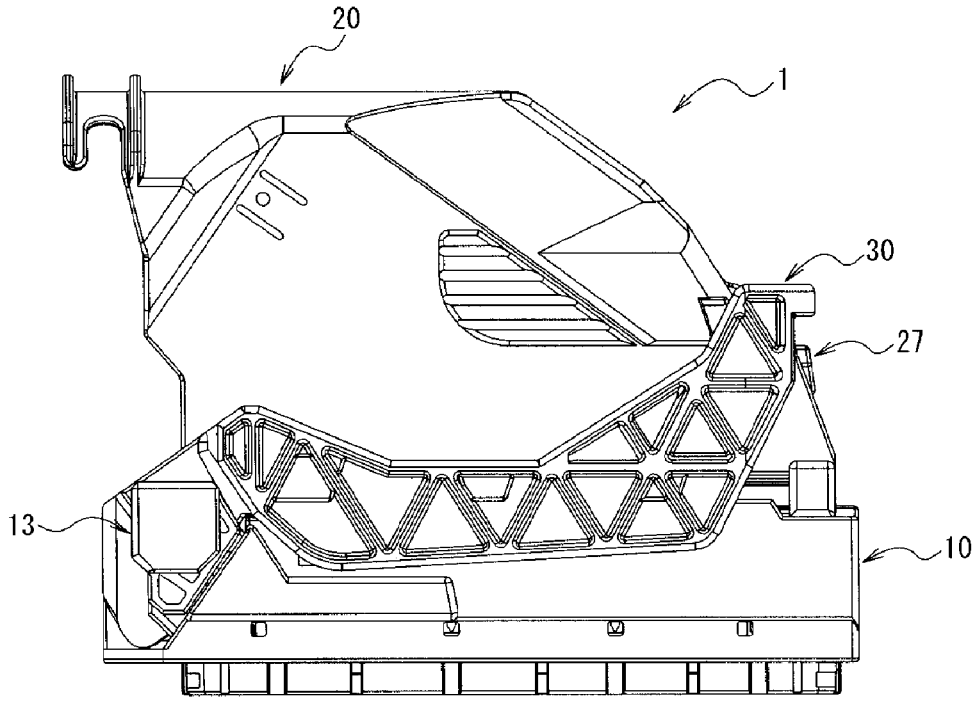
FIG. 19 is a plan view a lever-type connector according to the invention where a lever is turned to a final position on the front side.
Figure 20:
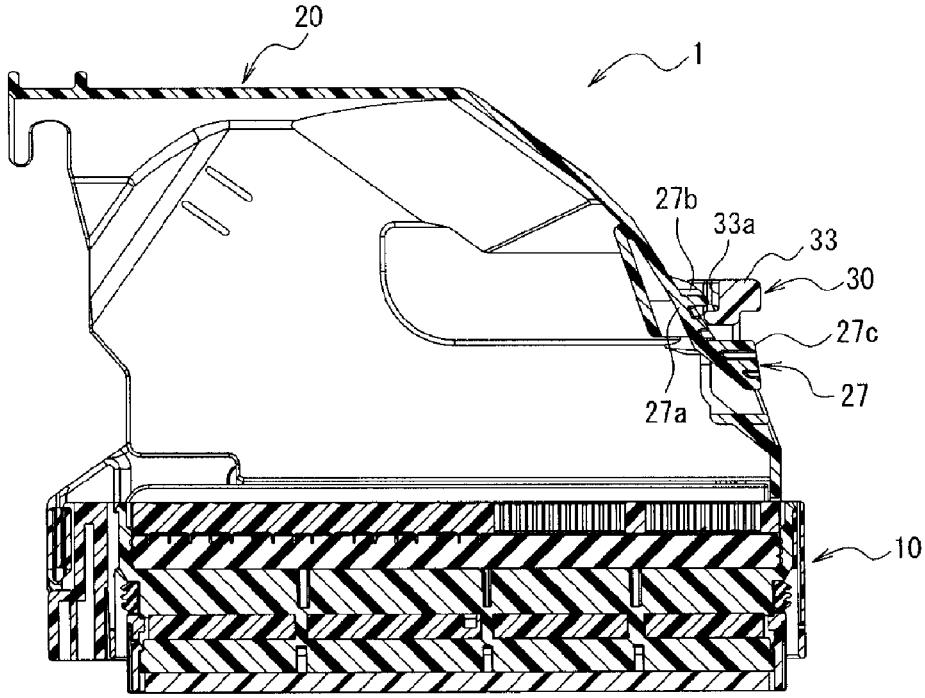
FIG. 20 is a cross-sectional view of the lever-type connector of FIG. 19.
Figure 21:
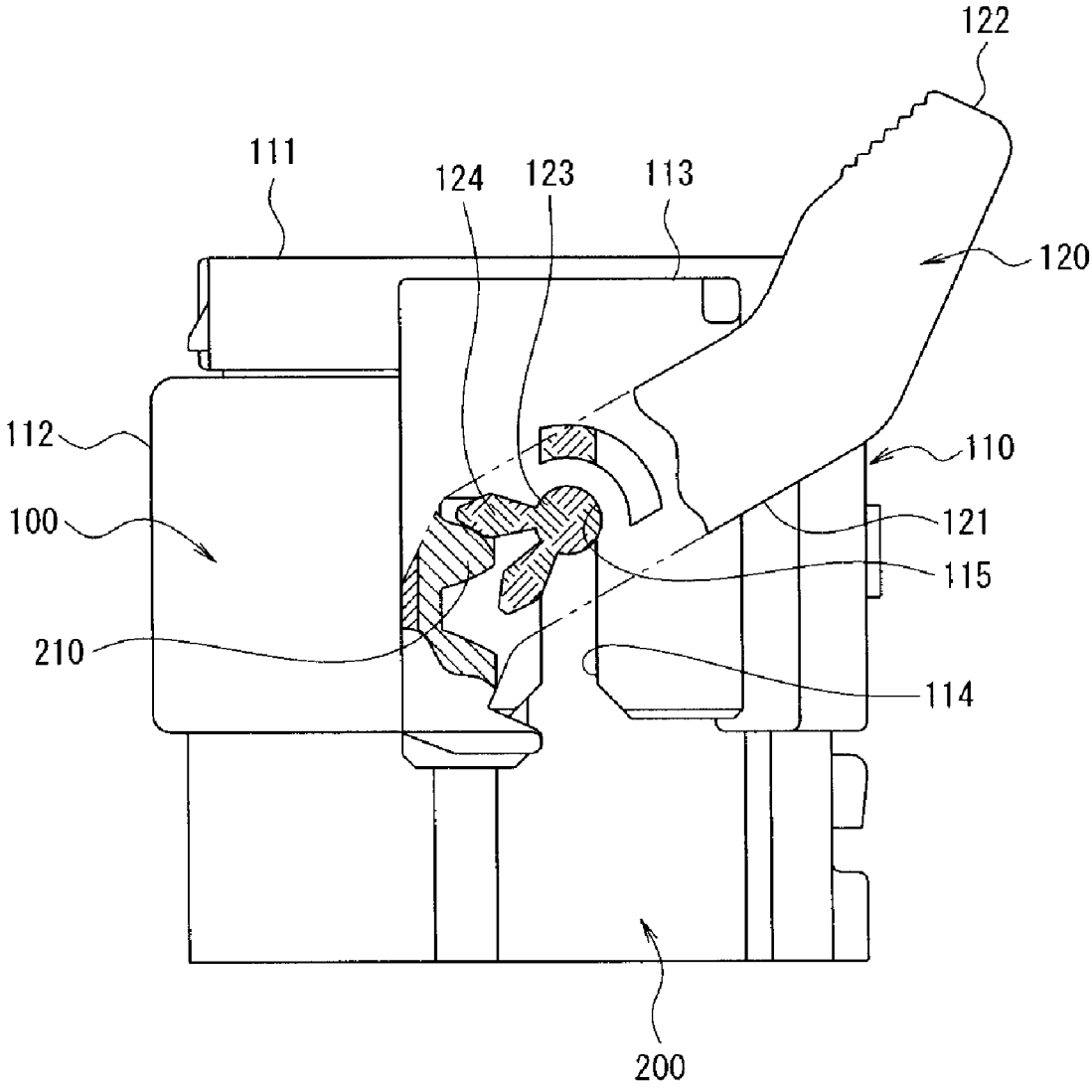
FIG. 21 is a plan view of a known lever-type connector.

Once the lever 30 is rotated until the final position on the front side, as shown in FIG. 19 and FIG. 20, mating of the lever-type connector 1 and the mating connector is then complete. The lever 30 that has been rotated until the final position on the front side is in a state unable to be rotated any further toward the front by bringing the sides of the notches 39 of both of the side plates 32 in contact with the rear surface of the fixing parts 29 of the wire cover 20. Moreover, the lever 30 that has been rotated until the final position is when rotation toward the rear is intercepted by the locking piece 27*b* of the lock 27 latching onto the depression 33*a* of the connecting part 33, as shown in FIG. 20.

Meanwhile, when releasing the mating of the lever-type connector 1 and the mating connector, the lock of the lever 30 by the lock 27 of the wire cover 20 is released, and the lever 30 that has been rotated until the final position on the front side is rotated toward the rear. When releasing the lock of the lever 30 by the lock 27 of the wire cover 20, the releasing projection portion 27*c* of the lock 27 is pushed in, and the plate spring 27*a* is bent inward, thereby releasing the latch on the depression 33*a* of the connecting part 33 to the lever 30 of the locking piece 27*b*.

Once the lever 30 is rotated toward the rear, the sliders 13 are moved in the direction of coming out from the slider receiving slot 12 of the housing 10 so that the multiple cam grooves of the sliders 13 push out the cam pins that are provided to the mating connector toward the front. As a result, the mating of the contacts accommodated in the housing 10 of the lever-type connector 1 and the contacts accommodated in the mating connector is released.

Once the lever 30 is rotated until the final position on the rear side, as shown in FIG. 18, release of the mating of the lever-type connector 1 and the mating connector is then complete.

A lever-type connector according to the invention prevents a worker from damaging a lever when removing the lever from a housing. Moreover, a lever-type connector according to the invention prevents a worker from damaging a lever when attaching the lever to a housing.

While the embodiments of the present invention have been illustrated in detail, various modifications to those embodiments are possible. Those skilled in the art will appreciate that various modifications, additions and substitutions are possible, without departing from the scope and spirit of the invention as disclosed in the accompanying claims.

What is claimed is:

1. A lever-type connector comprising:

a housing containing a contact;

a wire cover having a main body, stopper and a first tapered section formed between the main body and the stopper, the wire cover attached to a rear side of the housing; and a lever having a pair of side plates and a connecting part that connects the pair of side plates to each other, the lever rotatably attaches to the housing by bridging over the rear side of the wire cover with the wire cover inserted between the pair of side plates in a thickness direction;

wherein the main body has a smaller thickness than a distance between the pair of side plates and the stopper has a greater thickness than the distance between the pair of side plates;

wherein each side plate includes a connecting plate extending inward and joining with each other at an end opposite the connecting part.

2. The lever-type connector according to claim 1, further comprising a slider receiving slot positioned on an inner surface of the housing.

3. The lever-type connector according to claim 2, further comprising a slider received in the slider receiving slot so as to move freely.

4. The lever-type connector according to claim 3, wherein the lever includes a slider moving projection which joins to a projection receiving portion of the slider, the slider moving projection protrudes outward from an outer surface of an end of the pair of side plates.

5. The lever-type connector according to claim 1, wherein the pair of side plates are joined to each other by a depression positioned at the end of one of the side plates and a projection positioned on an end of the other side plate.

6. The lever-type connector according to claim 1, wherein the stopper is positioned to prevent further rotation of the lever.

7. The lever-type connector according to claim 1, further comprising a lock positioned on a rear surface of the main body.

8. The lever-type connector according to claim 7, wherein the lock includes a plate spring, a locking piece, and a release projection portion positioned on an outer surface of the plate spring, the locking piece positioned for latching onto a depression of the connecting part at a final position.

9. The lever-type connector according to claim 1, wherein the first tapered portion connects the main body to the stopper.

10. The lever-type connector according to claim 9, wherein the first tapered portion includes a slanted face that continues to a top surface of the main body and a top surface of the stopper, and a slated face that continues to a bottom surface of the main body and a bottom surface of the stopper.

11. The lever-type connector according to claim 1, further comprising a pivot positioned on the lever.

12. The lever-type connector according to claim 11, further comprising a pivot receiving portion positioned on an end of the housing and joining with the pivot.

13. The lever-type connector according to claim 12, further comprising a latch arm for locking the pivot of the lever when joined to the pivot receiving portion.

14. A lever-type connector comprising:

a housing containing a contact;

a wire cover having second tapered section formed on a rear side of the wire cover and having a thickness that gradually decreases outward, the wire cover attached to a rear side of the housing; and a lever having a pair of side plates and a connecting part that connects the pair of side plates to each other, the lever rotatably attaches to the housing by bridging the over the rear side of the wire cover and the wire cover is inserted between the pair of side plates;

wherein each side plate includes a connecting plate extending inward and joining with each other at an end opposite the connecting part.

15. The lever-type connector according to claim 14, further comprising a slider receiving slot positioned on an inner surface of the housing.

16. The lever-type connector according to claim 15, further comprising a slider received in the slider receiving slot.

17. The lever-type connector according to claim 16, wherein the lever includes a slider moving projection which joins to a projection receiving portion of the slider, the slider moving projection protrudes outward from an outer surface of an end of the pair of side plates.

18. The lever-type connector according to claim 14, further comprising a pivot positioned on the lever.

19. The lever-type connector according to claim 18, further comprising a pivot receiving portion positioned on an end of the housing and joining with the pivot.

20. The lever-type connector according to claim 19, further comprising a latch arm for locking the pivot of the lever when joined to the pivot receiving portion.

* * * * *